United States Patent [19]

Wirz et al.

[11] 4,184,674

[45] Jan. 22, 1980

[54] MONITORING DEVICE FOR MISSING AND SKEWED SHEETS IN SHEET FEEDS

[75] Inventors: Arno Wirz; Willi Becker, both of Bammental, Fed. Rep. of Germany

[73] Assignee: Heidelberger Druckmaschinen Aktiengesellschaft, Heidelberg, Fed. Rep. of Germany

[21] Appl. No.: 547,045

[22] Filed: Feb. 4, 1975

Related U.S. Application Data

[63] Continuation of Ser. No. 342,959, Mar. 20, 1973, abandoned.

[30] Foreign Application Priority Data

Mar. 25, 1972 [DE] Fed. Rep. of Germany ..... 2214720

[51] Int. Cl.[2] ..... B65H 7/08

[52] U.S. Cl. ..... 271/260; 192/128; 200/82 R; 271/261; 271/268

[58] Field of Search ..... 271/261, 260, 259, 268, 271/265, 227, 228, 258, 85, 14; 192/128; 200/82 R, 81.9 R

[56] References Cited

U.S. PATENT DOCUMENTS

| | | | |
|---|---|---|---|
| 597,652 | 1/1898 | McNutt | 271/258 X |
| 1,790,465 | 1/1931 | Dudley | 271/260 X |
| 2,922,646 | 1/1960 | Büttner | 271/268 |
| 2,937,020 | 5/1960 | Layden | 271/252 X |

FOREIGN PATENT DOCUMENTS

| | | | |
|---|---|---|---|
| 1143523 | 2/1969 | United Kingdom | 271/260 |

*Primary Examiner*—Bruce H. Stoner, Jr.
*Attorney, Agent, or Firm*—Herbert L. Lerner

[57] ABSTRACT

A monitoring device for missing and skewed sheets in sheet feeding devices on printing machines having feed grippers includes at least two sensors spaced along the width of the feed table for monitoring the front edge of the sheet being fed. The sensors have air outlet means which are disposed to be covered by a transported sheet when the latter is properly aligned.

7 Claims, 3 Drawing Figures

MONITORING DEVICE FOR MISSING AND SKEWED SHEETS IN SHEET FEEDS

This is a continuation of application Ser. No. 342,959, filed Mar. 20, 1973, now abandoned.

This invention relates to a monitoring device for missing and skewed sheets in sheet feeds of printing machines having feed grippers in which at least two sensors are distributed or spaced over the width of the feed table for monitoring the front edge of the sheet.

It is an objective of the present invention to ascertain faulty sheet transfer and to stop the printing machine or at least the feeding of sheets, as soon as the sheet feed has not gripped a sheet with the feed grippers during operation or the sheet transferred by the suction bar is in an excessively skewed position.

Monitoring devices for printing machines are known which control missing and skewed sheets by means of feeler pins. The feeler pins are mounted on an oscillating gripper shaft and are set on the transported sheet. In the absence of a sheet, the feeler pin falls through and, through further switching means, causes the printing machine to stop.

Mechanical monitoring by means of feeler pins takes effect only after the oscillating gripper arrives at the front edge of the sheet (front stop), so that, depending on the design principle, the printing machine receives the command to stop printing too late. These monitoring devices have the further disadvantage that due to the centrifugal force of the feeler pins, marks are made on the transported sheet which are not acceptable in terms of marketing requirements.

Monitoring devices are also known which operate with suction air. However, these known devices, have the disadvantage that paper dust is drawn in, and this makes them susceptable to operating difficulties.

Other known monitoring devices operate electromechanicaly, directly via a contact to ground. The interrogation of the sheet takes place at a given point in time. If the contact is not interrupted at the set time, the monitoring device initiates the stopping of the printing machaine. This known arrangement has the disadvantage that due to wear of the contacts, uniform reliability cannot be expected in continued operation.

It is an object of the present invention to overcome the aforementioned disadvatages of known prior art devices and to provide a monitoring device which interrogates for missing or skewed sheets without any contact by mechaical means, which does not obstruct the open view of the feed table and which may be provided at a cost within limits justifiable for small-format machines.

The aforementioned objectives are achieved by providing feelers or sensors in the form of blast or discharge nozzles which are located on the feed grippers and which are covered by a properly transported sheet.

Contactless interrogation by blast air is extremely simple and can be provided at extremely low cost in printing machines which already have a compressed-air generator. In addition the open view of the feed table is in no way obstructed. By using blast air, the danger that the air passages will become clogged by paper dust is obviated. A monitoring device according to the present invention is so sensitive that if even only one of the blast nozzles is not completely covered up, the stopping of the printing machine is initiated at an early point, that is at the moment when the sheet is gripped by the suction bar.

Other features which are considered as characteristic for the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
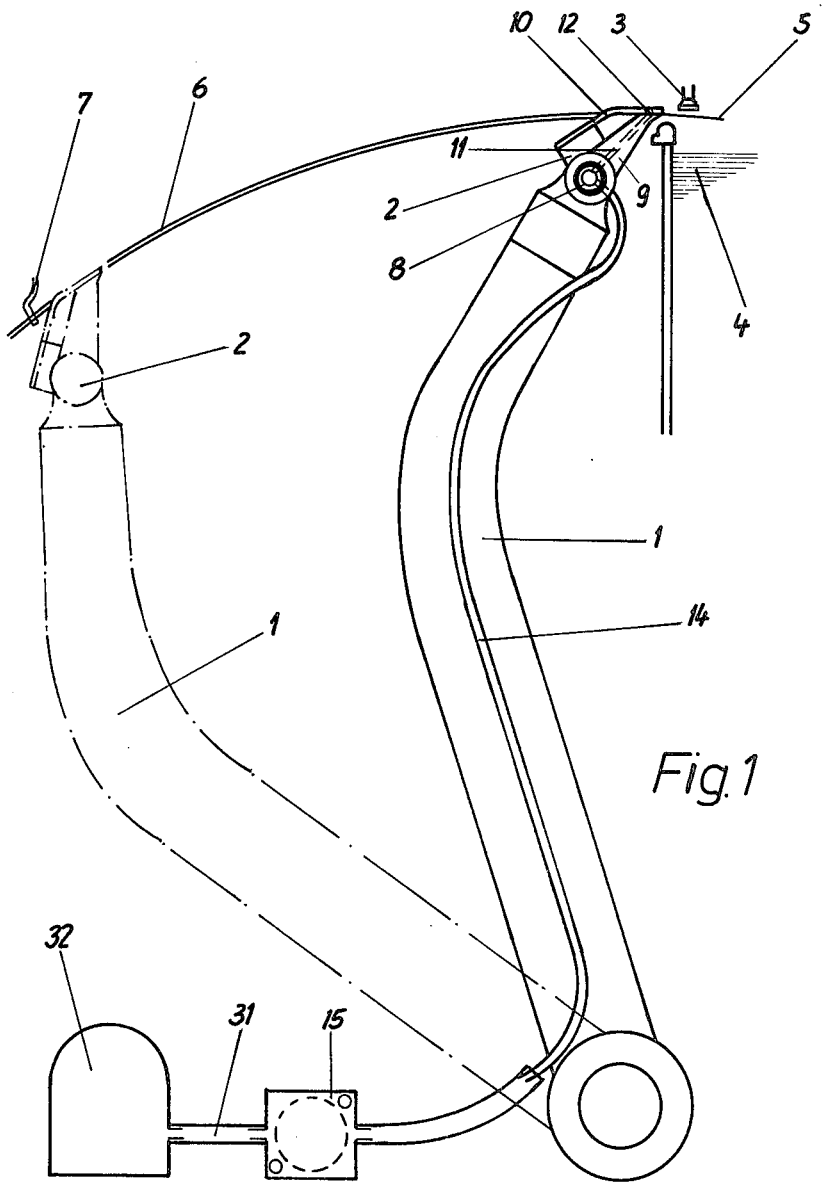
FIG. 1 is a partial elevational view of a sheet feeding device having an oscillating lever and which employs air operated sensors according to one embodiment of the invention.

Referring to the drawings, FIG. 1 shows a sheet feed device comprising an oscillating lever 1 on which feed grippers 2 are mounted. Suction elements 3 are provided to transfer a sheet 4 from a supply stack 4 to the feed grippers 2 whih then transport the sheet 5 across a feed table 6 to stops 7.

After the sheet 5 is laid or placed against the stops 7, the oscillating lever 1, due to its particular support, dips or passes below the feed table 6 and swings back into the original transfer position.

The feed grippers 2 are mounted on a carrier tube 8 disposed at the free end of the oscillating lever 1. The feed grippers 2 each consist of a gripper supprt 9 and a gripper finger 10. Within the gripper support 9, there is provided a drill hole 11 which opens centrally into the surface of the support area and which constitutes a blast nozzle according to the invention. A further hole 12 is provided in the gripper finger 10 which is coaxial with and leads from the hole 11. A sheet 5 which has been properly gripped by the feed grippers 2 covers up the opening of the hole 11 completely.

Figure 2:
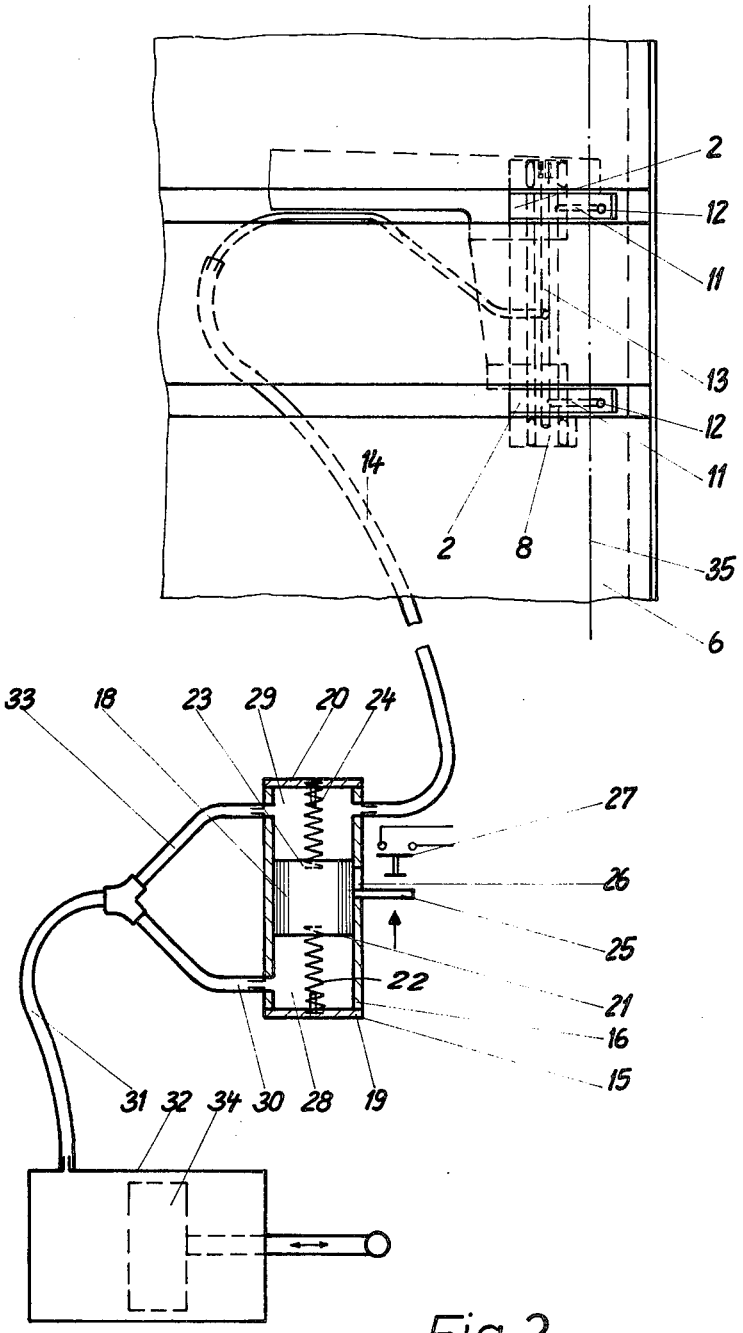
FIG. 2 is a top view of the sheet feeding device shown in FIG. 1 showing parts of the table as well as a cross section through a control valve operable with the sensors.
Figure 3:
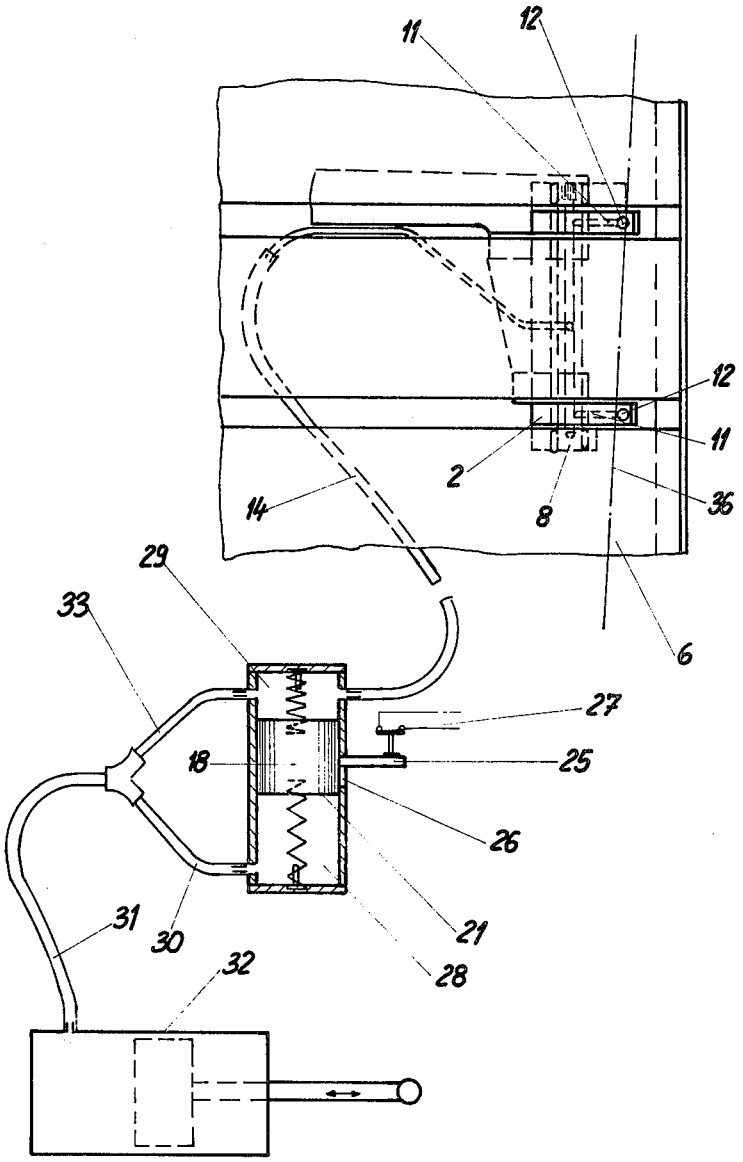
FIG. 3 is a top view similar to FIG. 2 but showing the control valve in a position in which the electric switch is closed.

As may be seen particularly in FIGS. 2 and 3, the holes 11 extend into or lead to a cross tube 13 in the carrier tube 8. The cross tube 13 in turn is connected to a connecting tube 14 which leads to a valve 15.

The valve 15 has a cylinder 16 in which a piston 18 is movably disposed and which is adapted to be acted upon from both sides. The cylinder 16 is closed off at both ends by covers 19 and 20. Between the lower cover 19 and the surface 21 of the piston 18 facing the cover 19, there is disposed a compression spring 22. Likewise, there is arranged another compression spring 24 between the cover 20 and the surface 23 of the piston 18 facing the cover 20. A laterally disposed switching pin 25, which protrudes from the cylinder 16 through a slot 26 in the cylinder 16, is attached to the periphery of the piston 18.

Due to the fact that the compression spring 24 is slightly stronger than the spring 22, the switching pin 25 normally is disposed at one end of the slot 26 as shown in FIG. 2. By means of this slight pretension, the piston 18 and switching pin 25 are movable in response to small disturbances which are generated by slight pressure differences in the lines leading to the cylinder 16. Disposed in the path of motion of the switching pin 25 is an electric switch 27. The switch 27 is closed when actuated by the switching pin 25 due to the displacement of the piston 18 in the cylinder 16. Closing of the switch 27 causes the printing machine to stop.

The piston 18 is normally disposed approximately in the middle of the cylinder 16 and thereby divides the latter into two practically equal pressure chambers 28 and 29. The pressure chamber 28 is connected via a branch line 30 and a pipe 31 to an air pump 32. A similar connection is provided between the pressure chamber 29 and the air pump 32 by means of a branch line 33 and the pipe 31. The air pump 32 operates in synchronism with the machine and has a piston 34 which is correlated, by means of a crank (not shown), with the motion of the oscillating lever 1 in such a manner that during the transport of the sheet 5 across the feed table 6, air is pushed or pumped into both pressure chambers 28 and 29. Since pressure chamber 29 is connected to the connecting line 14, the pressure chamber 29 will have a connection to the atmosphere if the hole 11 in the gripper support surface 9 is not covered up by a gripped sheet 5. Alternately, instead of the air pump 32, a compressor followed by a timing valve may be used.

In FIG. 2 the front edge of the gripped sheet 5 is represented by a broken line 35. Because the gripped sheet is not in a skewed position, the sheet completely covers the opening of the hole 11 in the gripper support 9 of both feeding grippers 2. The hole 12 in the gripper fingers 10 are therefore also covered completely by the gripped sheet. If during the travel of the sheet 5 across the feed table 6, the air pump 32 blows or discharges compressed air into two pressure chambers 28 and 29 of the control valve 15, the force or pressure acting on the piston 18 from both sides is equal, as neither of the pressure chambers is connected to the atmosphere and accordingly, both exposed areas of the piston 19 are equal.

As a consequence, the piston 18 does not move, and the switching pin 25 does not close the switch 27. This condition is shown in FIG. 2. Before the feed grippers 2 place the gripped sheet against the stops 7 and thereby release it, the overpressure or pressure in the pressure chambers 28 and 29 is decreased again to atmospheric pressure due to the synchronous operation of the air pump as described previously.

However, in cases where the suction members 3 do not transfer a sheet to the feed grippers 2, or the front edge of the sheet is for any reason in a skewed position and therefore does not cover the holes 11 and 12 completely, as is shown for example in FIG. 3 by means of the broken line 36, the pressure chamber 29 will be vented via the connecting line 14 and the holes 11 and 12 during the travel of the sheet 5. As a consequence, the compressed air generated by the air pump 32 acts essentially only on the piston surface 21 of the pressure chamber 28. The resulting pressure difference pushes the piston 18 into the pressure chamber 29. Accordingly, the switching pin 25 moves in the slot 26 and strikes or contacts the switch 27 which is thereby closed. As already mentioned herein before, the closing of the switch 27 causes the printing to stop. In order to obtain this result, it is sufficient that only a small part of the area of one of the holes 11 designed as blast nozzles in the feed grippers 2 is not covered up by the sheet. Thus, this illustrated embodiment offers extremely effective protection against missing or skewed sheets.

The sheet feed shown in the drawings uses only two feed grippers with corresponding blast nozzles in the form of holes 11 and 12. If the feeder is wider, the number of interrogation points may, for example, be expanded to four, according to the invention, in order to increase the reliability of the device for greater sheet widths.

We claim:

1. Monitoring device for missing and skewed sheets in sheet feeding devices of printing machines, comprising feed grippers for transporting a sheet across the top of a feed table from a first location to a second location, oscillating lever means carrying said gripper means, said oscillating lever means being located below the feed table, and at least two spaced sensor means provided on said feed grippers, said sensor means having air outlet means which are disposed to be covered by a transported sheet when the latter is properly aligned, conduit means connecting said sensor means on each of said feed grippers, valve means being in said conduit means, said valve means comprising a cylinder, a piston operable within said cylinder, said piston dividing said cylinder into two chambers and being acted upon from two sides by pressure within the chambers on either side of the piston, spring means normally maintaining said piston in a centrally disposed position, said cylinder having an opening, said piston having a switching pin extending through said opening, a switch activated by said switching pin when said piston is displaced from its normally disposed central position when one of said chambers is vented through said conduit means leading to said sensor means.

2. Monitoring device according to claim 1 further comprising means for supplying compressed air to said sensor means through said valve means.

3. Monitoring device according to claim 2 wherein said means for supplying compressed air operates in synchronism with the operation of the sheet feed device to provide compressed air to said means when said feed grippers are in said first position.

4. Monitoring device according to claim 3 wherein said means for supplying compressed air to said sensor means operates so that the air at said sensor means is substantially at atmospheric pressure when said feed grippers are at said second location.

5. Monitoring device according to claim 2 wherein said means for supplying compressed air supplies compressed air to both of said chambers.

6. Monitoring device according to claim 1 having two springs, one of said springs biasing said piston in one direction and the other of said springs biasing said piston in an opposite direction, one of said springs having a stronger biasing force than the other to normally bias said piston in said centrally disposed position.

7. Monitoring device according to claim 1 wherein the pressure in both of said chambers is substantially equal when both of said outlet means are covered by said transported sheet.

* * * * *